United States Patent [19]

Komori

[11] Patent Number: 4,747,707

[45] Date of Patent: May 31, 1988

[54] LABEL PRINTER

[75] Inventor: Yasuo Komori, Shizuoka, Japan

[73] Assignee: Tokyo Electric Co., Ltd., Tokyo, Japan

[21] Appl. No.: 943,729

[22] Filed: Dec. 19, 1986

[30] Foreign Application Priority Data

Dec. 27, 1985 [JP] Japan ..... 60-202277[U]

[51] Int. Cl.[4] ..... B41J 3/54; B41J 3/56

[52] U.S. Cl. ..... 400/82; 400/120; 400/185

[58] Field of Search ..... 400/82, 185, 187, 120

[56] References Cited

U.S. PATENT DOCUMENTS 4,676,155 6/1987 Harry et al. ..... 101/110

FOREIGN PATENT DOCUMENTS 201873 11/1984 Japan ..... 400/82

OTHER PUBLICATIONS

"Printer with Dual Print Stations", by Kanno, *IBM Technical Disclosure Bulletin,* vol. 20, No. 9, pp. 3537–3538, 2–1978.

*Primary Examiner*—Edgar S. Burr
*Assistant Examiner*—Moshe I. Cohen
*Attorney, Agent, or Firm*—Oblon, Fisher, Spivak, McClelland & Maier

[57] ABSTRACT

A label printer of the type including two printing devices which can issue a label and record paper at locations near to each other with printed faces thereof directed to the front is realized by a specific arrangement of two printing devices and two supply devices without increasing the overall size of the printer. The label printer comprises a first printing device including a first print head mounted for up and down pivotal motion and for engagement with an upper face of a first platen, a second printing device located within a same vertical volume below the first printing device and including a second print head mounted for up and down pivotal motion and for engagement with a lower face of a second platen, a first supply means located behind the first printing device for holding a backing sheet in the form of a roll to which a large number of labels are applied and for supplying the backing sheet to the first printing device with the labels directed upwardly, and a second supply means for holding elongated record paper in the form of a roll with a printing face thereof directed outwardly and for supplying the record paper to the second printing device with the printing face of the record paper directed downwardly.

10 Claims, 2 Drawing Sheets

LABEL PRINTER

FIELD OF THE INVENTION

This invention relates to a label printer for printing a predetermined matter on a label and issuing the label after printing, and more particularly to a label printer which includes two independent printing devices therein.

BACKGROUND OF THE INVENTION

Label printers which include two different printing devices therein have been already provided. One of the two printing devices is provided for printing on a label while the other printing device is provided for printing on record paper in the form of a web such as a receipt or a journal paper. Label printers of such a construction eliminate the necessity to exchange, in use, an object for printing such as a label each time the object for printing is to be altered. For example, when a receipt is to be printed just after a label has been printed, it is not necessary to load the receipt instead of the label. This is convenient for an operator and will quicken intended printing.

Now, problems of such prior art will be described. Now that a label printer includes two independent printing devices, naturally it also includes two independent objects for printing such as a label and record paper. Normally, those objects for printing are each held in the form of a roll. However, those objects for printing have a large volume and thus occupy a wide space within the printer. Accordingly, it is a drawback that the size of the entire printer must be large accordingly.

Meanwhile, separate motors are provided for the individual printing devices as means for independently driving the printing devices. Accordingly, it is also a drawback that the number of motors is large and a motion transmitting mechanism is complicated. Besides, such a large number of motors and the motion transmitting mechanism of such a complicated structure will further increase the overall size of the printer.

OBJECTS OF THE INVENTION

It is a first object of the present invention to provide a label printer of the type including two printing devices wherein the overall size thereof can be reduced.

It is a second object of the invention to provide a label printer of the type including two printing devices wherein contents of printing on print media such as a label or record paper can be observed in a natural posture of an operator when they are issued.

It is a third object of the invention to provide a label printer of the type including two printing devices wherein a mechanism for transmitting a motion to the printing devices can be simplified.

SUMMARY OF THE INVENTION

In order to attain the objects, according to one aspect of the present invention, there is provided a label printer which comprises a first printing device including a first print head mounted for up and down pivotal motion and for engagement with an upper face of a first platen, a second printing device located within a same vertical volume below the first printing device and including a second print head mounted for up and down pivotal motion and for engagement with a lower face of a second platen, a first supply means located behind the first printing device for holding backing sheet in the form of a roll to which a large number of labels are applied and for supplying the backing sheet to the first printing device with the labels directed upwardly, and a second supply means for holding elongated record paper in the form of a roll with a printing face thereof directed outwardly and for supplying the record paper to the second printing device with the printing face of the record paper directed downwardly.

Thus, the overasll size of the printer can be reduced for the reasons that the first and second printing devices are located within the same vertical volume, that the two printing devices can be located near each other, and that the location of the first supply means will not interfere with locations of any other components of the printer. Besides, a label and record paper are issued at locations near each other with printed faces thereof directed to the front. Since record paper is held in the form of a roll at the second supply means, it is provided with a curling habit which turns, when the record paper is to be issued, the record paper upwardly to direct the printed face of the same to the front after it has passed the second printing device. Accordingly, an operator can observe contents of printing on the label and the record paper in a natural posture.

Further, according to another aspect of the present invention, two one-way clutches for transmitting rotation in opposite directions are provided, whereby two printing devices are alternately driven by a bidirectional motor via the one-way clutches. In this arrangement, a mechanism for transmitting a motion to the printing devices can be simplified. Particularly where the two one-way clutches are disposed in a coaxial relationship with a rotary shaft of the motor, the motion transmitting mechanism can be further simplified and the overall size of the printer can be reduced accordingly.

DESCRIPTION OF THE PREFERRED EMBODIMENT

Figure 1:
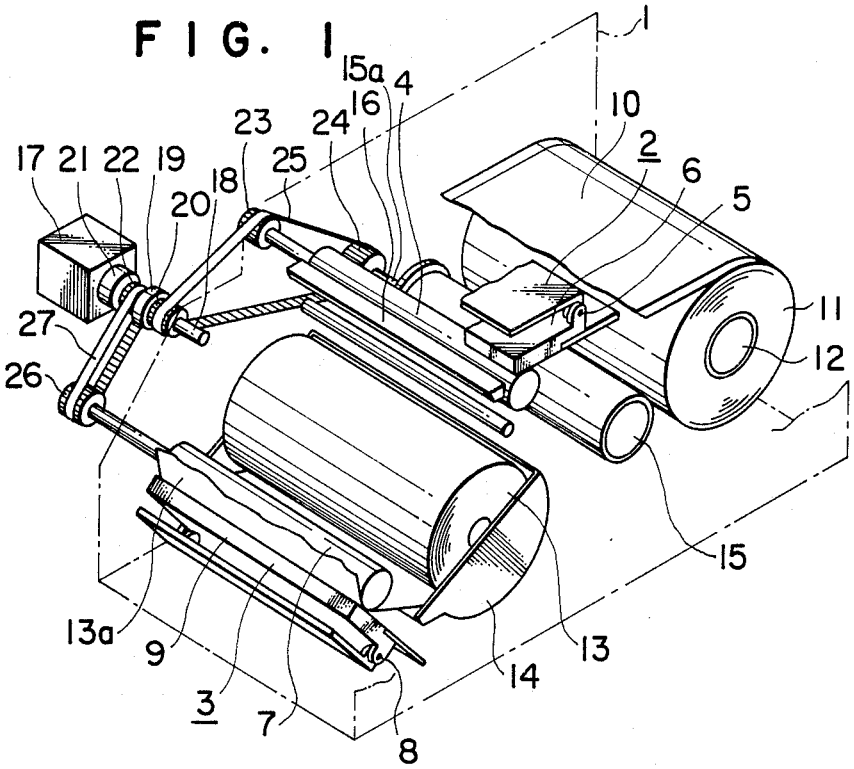
FIG. 1 is a perspective view of an entire printer illustrating a preferred embodiment of the present invention.
Figure 2:
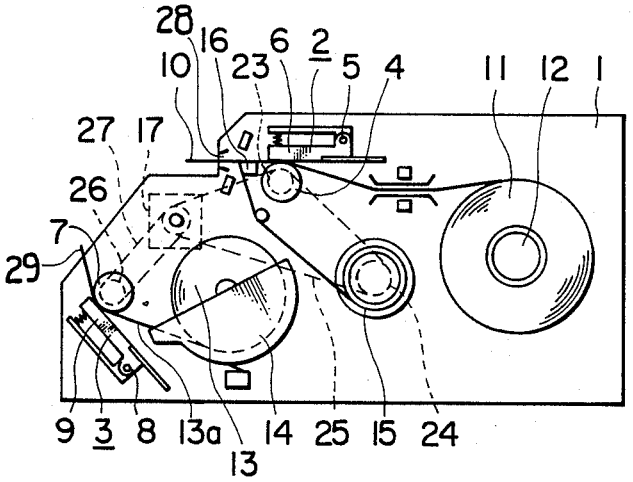
FIG. 2 is a side elevational view of the printer of FIG. 1.

Now, a preferred embodiment of the present invention will be described with reference to the accompanying drawings. The printer shown includes a frame 1 in the form of a housing. A first printing device 2 and a second printing device 3 are located within the frame 1. The first printing device 2 includes a first platen 4 and a first thermal head 6 which serves as a first print head. The first printing device 2 is located above the second printing device 3 within the same vertical volume (i.e., a vertical volume including the plane of FIG. 2 and bound by planes vertical to the ends of the first platen 4). The first thermal head 6 is mounted for up and down pivotal motion on a first support shaft 5 and normally contacts with an upper face of the first platen 4. Thus, the first thermal head 6 can be pivoted upwardly away from the first platen 4.

Meanwhile, the second printing device 3 includes a second platen 7 and a second thermal head 9 which serves as a second print head. The second thermal head 9 is mounted for up and down pivotal motion on a second support shaft 8 and normally contacts with a lower face of the second platen 7. Thus, the second thermal head 9 can be pivoted downwardly away from the second platen 7.

A supply shaft 12 serving as a first supply device is located behind the first printing device 2 and is mounted for rotation on the frame 1. Elongated backing sheet 11 in the form of a roll is carried on the supply shaft 12 and has a large number of labels 10 removably attached to it in an equidistantly spaced relationship thereto. Meanwhile, an upwardly open hopper 14 serving as a second supply device is fixedly located between the first and second printing devices 2 and 3. Elongated record paper 13 in the form of a wound roll is placed on the hopper 14 with a printing face 13*a* thereof directed outwardly.

Meanwhile, a label exfoliating member 16 for bending the backing sheet 11 at an acute angle to exfoliate a label 10 from the backing sheet 11 is located forwardly of the first platen 4. The label exfoliating member 16 is secured to the frame 1.

A take-up shaft 15 is supported for rotation on the frame 1 between the supply shaft 12 and the hopper 14. A torque limiter not shown is incorporated in the take-up shaft 15. The torque limiter yields a slip between the take-up shaft 15 and a support shaft 15*a* on which the take-up shaft 15 is supported when a load higher than a predetermined level is applied. The backing sheet 11 after passing the label exfoliating member 16 is wound on and carried by the take-up shaft 15.

A bidirectional motor 17 for driving the first platen 4, the second platen 7 and the take-up shaft 15 is carried on a side wall of the frame 1. A pair of one-way clutches 19, 21 are mounted on a rotary shaft 18 of the motor 17. The one-way clutch 19 transmits counterclockwise rotation of the rotary shaft 18, while the other one-way clutch 21 transmits clockwise rotation of the rotary shaft 18. A pulley 20 is connected to the output side of the one-way clutch 19, while another pulley 22 is connected to the output side of the other one-way clutch 21. A further pulley 23 is directly connected to an end of the first platen 4, while yet another pulley 24 is directly connected to an end of the take-up shaft 15. A timing belt 25 extends between and around the pulleys 23, 24 and the pulley 20 of the one-way clutch 19. An additional pulley 26 is directly connected to an end of the second platen 7, and another timing belt 27 extends between and around the pulley 26 and the pulley 22 of the one-way clutch 21.

It is to be noted that a label issuing port 28 is provided at a portion of the frame 1 at which a label 10 is issued, and a discharging port 29 is provided at another portion of the frame 1 at which the record paper 13 is discharged.

Figure 3:
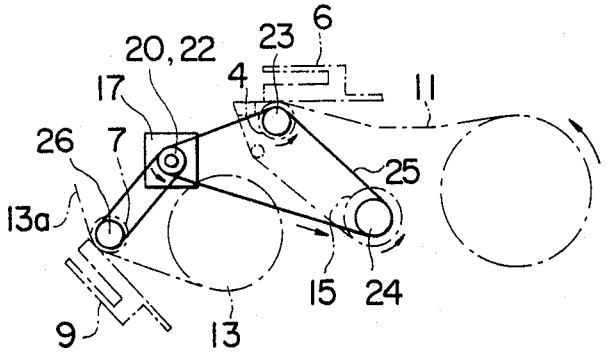
FIG. 3 is a side elevational view illustrating a motion transmitting route for driving a first platen and a take-up shaft.
Figure 4:
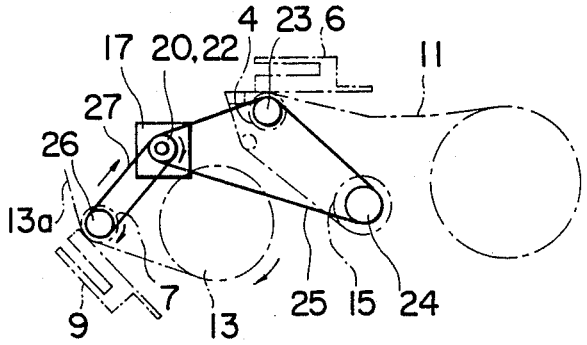
FIG. 4 is a side elevational view illustrating another motion transmitting route for driving a second platen.

With the construction described above, the first thermal head 6 prints on a label 10 on the first platen 4 and the second thermal head 9 prints on record paper 13 on the second platen 7 in response to a printing signal. Then, the motor 17 is rotated a predetermined angle in the counterclockwise direction. This angular rotation is transmitted to the first platen 4 and the take-up shaft 15 via the one-way clutch 19 and the timing belt 25 as seen in FIG. 3. Consequently, the ground paper 11 is wound onto the take-up shaft 15 while the label 10 is exfoliated from the ground paper 11 by the label exfoliating member 16 and is issued. In this instance, the winding speed of the backing sheet 11 by the take-up shaft 15 is not higher than the feeding speed of the backing sheet 11 by the first platen 4. This is because if a load higher than the predetermined level is applied against the turning force of the take-up shaft 15, the torque limiter incorporated in the take-up shaft 15 will operate. Accordingly, a slip of the backing sheet 11 at the first printing device 2 is prevented. To the contrary, if the motor 17 is rotated in the clockwise direction, this rtation is transmitted to the second platen 7 via the one-way clutch 21 and the timing belt 27 as seen from FIG. 4. Consequently, the record paper 13 is fed forwardly and thus issued.

Meanwhile, since the first and second printing devices 2 and 3 are located within the same vertical volume, the space of the printer in a widthwise direction can be utilized effectively. Further, since the two thermal heads 6, 9 do not interfere with each other when they are pivoted, it is possible to locate the two printing devices 2, 3 near to each other. Besides, since particularly in the present embodiment the hopper 14 is located within a small space between the first and second printing devices 2 and 3, the space required for location of record paper 13 can be reduced. In addition, the supply shaft 12 is located rearwardly of the first printing device 2 where it will not interfere with locations of any other members. From those reasons, the overall size of the printer can be reduced.

Besides, a label 10 is issued horizontally with a printed face thereof directed upwardly. To the contrary, when the record paper 13 is issued, it is turned upwardly in such a manner that a printed face 13*a* thereof may be directed to the front due to its curling habit after it has passed the second printing device 3. Accordingly, the direction of issuing a label 10 at the label issuing port 28 and the direction of discharging the record paper 13 at the discharging port 29 will intersect each other after all. Consequently, as a label 10 and the record paper 13 are issued, they are issued at locations near to each other with their respective printed faces directed to the front. Accordingly, even with a printer of a reduced size, an operator can observe contents of printing on the label 10 and the record paper 13 while assuming a natural posture.

In addition, the provision of the one-way clutches 19, 21 allows the single motor 17 to be used to drive both of the first printing device 2 and the second printing device 3. Such common use of the motor 17 will reduce the number of motors to be employed in the printer and simplify the construction of the motion transmitting mechanism. Besides, as a result of such reduction of the number of motors and such simplification of the construction of the motion transmitting mechanism, the overall size of the printer can be further reduced.

What is claimed is:

1. A label printer comprising:

(a) a first print device comprising:

(i) a first platen rotatable about a first axis and (ii) a first printing head mounted for pivotal movement between a first position in which it is in close proximity to said first platen on the side of said first platen that is upward during normal use of said label printer and a second position in which it is spaced from said first platen;

(b) a second printing device comprising:

(i) a second platen rotatable about a second axis, said second axis being parallel to said first axis and said first and second platens being located in the same vertical volume defined by planes vertical to the ends of said first platen, and (ii) a second print head mounted for pivotal movement between a first position in which it is in close proximity to said second platen on the side of said second platen that is downward during normal use of said label printer and a second position in which it is spaced from said second platen;

(c) a supply shaft rotatable about a third axis, said third axis being parallel to said first axis and said supply shaft being located in the same vertical volume as is said second platen, a roll of backing sheet on which a large number of labels are attached being mounted on said supply shaft during normal use of said label printer;

(d) a take-up shaft rotatable about a fourth axis, said fourth axis being parallel to said first axis and said take-up shaft being located in the same vertical volume as is said second platen, said take-up shaft serving to take up the backing sheet after removal of the labels during normal use of said label printer;

(e) a label exfoliating member located downstream of said first printing device and upstream of said take-up shaft;

(f) first means for holding a roll of an elongated record medium having a fifth axis such that said fifth axis is parallel to said first axis and the roll of elongated record medium is located in the same vertical volume as is said second platen;

(g) a bidirectional motor having an output shaft that is rotatable about a sixth axis, said sixth axis being parallel to said first axis;

(h) second means for transmitting the rotation of said output shaft in one direction to said first platen and said take-up shaft while not rotating said second platen, thereby issuing printed labels; and (i) third means for transmitting the rotation of said output shaft to said second platen while not rotating said first platen and said take-up shaft, thereby advancing the elongated record medium.

2. A label printer as recited in claim 1 wherein said first means is an upwardly open hopper.

3. A label printer as recited in claim 1 wherein said second means comprise:

(a) a first one-way clutch mounted on said output shaft;

(b) a first pulley mounted on said output shaft in operative association with said first one-way clutch;

(c) a second pulley in operative association with said first platen;

(d) a third pulley in operative association with said take-up shaft; and (e) a first belt trained over said first, second, and third pulleys.

4. A label printer as recited in claim 3 wherein said third means comprise:

(a) a second one-way clutch mounted on said output shaft;

(b) a fourth pulley mounted on said output shaft in operative association with said second one-way clutch;

(c) a fifth pulley in operative association with said second platen; and (d) a second belt trained over said fourth and fifth pulleys.

5. A label printer as recited in claim 1 wherein said third means comprise:

(a) a second one-way clutch mounted on said output shaft;

(b) a fourth pulley mounted on said output shaft in operative association with said second one-way clutch;

(c) a fifth pulley in operative association with said second platen; and (d) a second belt trained over said fourth and fifth pulleys.

6. A label printer comprising:

(a) a first print device comprising:

(i) a first platen rotatable about a first axis, and (ii) a first printing head mounted for pivotal movement between a first position in which it is in close proximity to said first platen on the side of said first platen that is upward during normal use of said label printer and a second position in which it is spaced from said first platen;

(b) a second printing device comprising:

(i) a second platen rotatable about a second axis, said second axis being parallel to said first axis and said first and second platens being located in the same vertical volume defined by planes vertical to the ends of said first platen, and (ii) a second print head mounted for pivotal movement between a first position in which it is in close proximity to said second platen on the side of said second platen that is downward during normal use of said label printer and a second position in which it is spaced from said second platen;

(c) a supply shaft rotatable about a third axis, said third axis being parallel to said first axis and said supply shaft being located in the same vertical volume as is said second platen, a roll of backing sheet on which a large number of labels are attached being mounted on said supply shaft during normal use of said label printer;

(d) first means for holding a roll of an elongated record medium having a fourth axis such that said fourth axis is parallel to said first axis and the roll of elongated record medium is located in the same vertical volume as is said second platen;

(e) a bidirectional motor having an output shaft that is rotatable about a fifth axis, said fifth axis being parallel to said first axis;

(f) second means for transmitting the rotation of said output shaft in one direction to said first platen while not rotating said second platen, thereby issuing printed labels; and (g) third means for transmitting the rotation of said output shaft to said second platen while not rotating said first platen, thereby advancing the elongated record medium.

7. A label printer as recited in claim 6 wherein said first means is an upwardly open hopper.

8. A label printer as recited in claim 6 wherein said second means comprise:

(a) a first one-way clutch mounted on said output shaft;

(b) a first pulley mounted on said output shaft in operative association with said first one-way clutch;

(c) a second pulley in operative association with said first platen;

(d) a third pulley in operative association with a take-up shaft; and (e) a first belt trained over said first, second, and third pulleys.

9. A label printer as recited in claim 8 wherein said third means comprise:

(a) a second one-way clutch mounted on said output shaft;

(b) a fourth pulley mounted on said output shaft in operative association with said second one-way clutch;

(c) a fifth pulley in operative association with said second platen; and (d) a second belt trained over said fourth and fifth pulleys.

10. A label printer as recited in claim 6 wherein said third means comprise:

(a) a second one-way clutch mounted on said output shaft;

(b) a fourth pulley mounted on said output shaft in operative association with said second one-way clutch;

(c) a fifth pulley in operative association with said second platen; and (d) a second belt trained over said fourth and fifth pulleys.

* * * * *